US005702058A

United States Patent [19]

Dobbs et al.

[11] Patent Number: 5,702,058

[45] Date of Patent: Dec. 30, 1997

[54] DUAL FOAMER NOZZLE ASSEMBLY FOR TRIGGER SPRAYER

[75] Inventors: Douglas B. Dobbs, Yorba Linda, Calif.; Linn Wanbaugh, Lee's Summit, Mo.

[73] Assignee: Calmar Inc., City of Industry, Calif.

[21] Appl. No.: 650,602

[22] Filed: May 20, 1996

Related U.S. Application Data

[63] Continuation-in-part of Ser. No. 392,397, Feb. 22, 1995, Pat. No. 5,647,539, which is a continuation-in-part of Ser. No. 352,805, Dec. 1, 1994, abandoned.

[51] Int. Cl.[6] ..... B05B 9/043

[52] U.S. Cl. ..... 239/343; 239/504; 239/333

[58] Field of Search ..... 239/333, 343, 239/504, 505

[56] References Cited

U.S. PATENT DOCUMENTS

| | | | |
|---|---|---|---|
| 4,219,159 | 8/1980 | Wesner | 239/343 |
| 4,350,298 | 9/1982 | Tada | 239/333 |
| 4,925,106 | 5/1990 | Maas et al. | 239/343 |

FOREIGN PATENT DOCUMENTS

| | | | |
|---|---|---|---|
| 2024049 | 1/1980 | United Kingdom | 239/343 |

*Primary Examiner*—Matthew C. Graham

*Attorney, Agent, or Firm*—Watson Cole Stevens Davis, P.L.L.C.

[57] ABSTRACT

A foamer nozzle assembly has a foaming barrel defining a turbulence chamber for creating foam upon actuation of the trigger of a trigger sprayer as the conical spray impacts against the smooth inner surface of the barrel as so to emerge as loosely compacted, large foam bubbles having a relatively wide foam spread. A foaming grid in the form of an offset rectangular mesh screen is mounted on a hinged panel for movement between operative and inoperative positions. In the former the grid lies coaxial with the discharge orifice and provides a supplemental foam generator for breaking up the foam bubbles into finer and more concentrated foam having a relatively smaller foam spread. The grid comprises first and second sets of ribs lying in first and second parallel planes, the ribs of the first set being contiguous to the ribs of the second set, and the ribs being mutually spaced apart to define uniformly sized openings therebetween. The ribs of both sets have flat surfaces facing upstream and lie perpendicular to the central axis of the barrel.

2 Claims, 2 Drawing Sheets

DUAL FOAMER NOZZLE ASSEMBLY FOR TRIGGER SPRAYER

RELATED APPLICATION

This application is a continuation-in-part of application U.S. Ser. No. 08/392,397,now U.S. Pat. No. 5,647,539 filed Feb. 22, 1995 as a continuation-in-part of application Ser. No. 08/352,805, filed Dec. 1, 1994 , and now abandoned.

BACKGROUND OF THE INVENTION

This invention relates generally to foamer nozzles for trigger sprayers, and more particularly to foamer nozzles having a turbulence chamber for creating foam, and a supplemental foam generator which can be moved into and out of service for creating a finer and more dense foam when desired.

The aforementioned related applications are is directed to a foamer nozzle assembly having a dedicated dual foam generating feature which includes a cylinder defining a turbulence chamber and a grid mounted adjacent the terminal end of the cylinder for enhancing foaming. A high quality foam is created with a reduced amount of airborne droplets and which does not dribble when applied to the target but which hangs to the target through an acceptable interval. The foam is comprised of fine bubbles having a concentrated foam spread.

There is a market demand for product delivery to a surface with a less concentrated and wider foam spread for certain applications while selectively enabling the user to apply foam product to the target with a more dense and concentrated foam as well.

U.S. Pat. No. 4,350,298 to Canyon Corporation, of Tokyo, Japan, discloses a trigger sprayer having a hinged panel forming an obstacle wall with which the spray liquid from the discharge orifice collides when the foam dispenser is at the foaming position. A plurality of cross arms define the obstacle wall such that the liquid spray from the orifice collides with the cross arms and scatters, thereby creating foam.

Although not disclosed in this patent, it is known that Canyon Corporation has commercialized a trigger foamer having a fixed barrel coaxial with the discharge orifice, and a fixed obstacle wall at the end of that barrel in the form of a plurality of cross arms as disclosed in FIG. 3 of its patent. Thus, foaming is generated in the same manner as disclosed in the '298 patent except that the foam dispenser is a dedicated foamer to effect coarse foaming in the form of a relatively large foam spread.

This known foamer likewise has a hinged panel with an obstacle wall in the form of similar cross arms which, in an operative position, are coaxial with the obstacle wall at the end of the barrel surrounding the discharge orifice. A finer foam and smaller foam spread is said to be effected when spraying through both the first and second obstacle walls with the hinged panel in service.

However, such an obstacle wall in the form of cross arms has been found ineffective in generating foam in a manner which significantly reduces the amount of airborne droplets into the atmosphere while at the same time creating an acceptable quality foam which does not dribble when applied to the target and which hangs to the target through an acceptable interval. Thus, whether coarse foaming is effected through the fixed obstacle wall, or whether the finer foam is created through the hinged obstacle wall of the aforedescribed known foamer, the foam bubbles created have been found to be of unacceptable quality especially as regards the measured hangtime on the target. The foam, whether coarse or fine, is wetter beyond acceptable standards, and is not as rich and compact to meet the demands in the marketplace.

SUMMARY OF THE INVENTION

It is therefore an object of the present invention to provide a dual foamer nozzle assembly for a trigger sprayer having a dedicated foam generator for creating a coarse foam, and having a supplemental foam generator for selectively creating a finer and more dense foam, in an effective and economical manner which avoids the problems experienced with the prior art.

This objective is achieved by the provision of a fixed cylinder defining a turbulence chamber into which the spray from the orifice issues and impacts against the smooth inner wall of the cylinder for effecting a coarse foam of a relatively large foam spread.

The supplemental foam generator according to the invention is of molded plastic construction mounted to the spray nozzle, and includes a hinged grid pivotable about a hinge axis between an operative position coaxial with the barrel and an inoperative position hinged away from the barrel. The grid comprises first and second sets of molded ribs as disclosed in FIGS. 7 and 8 of the aforementioned '539 patent, and referred to herein as an offset rectangular molded mesh foaming screen or grid.

The first and second sets respectively lie in first and second parallel planes, the ribs of the first set being contiguous to the ribs of the second set, and the ribs in each of the sets being mutually spaced apart to define uniformly sized openings therebetween through which the coarse foam bubbles emerge to foam a finer and more dense foam. The ribs of both sets have flat surfaces facing upstream and lie perpendicular to the central axis of the barrel in the operative position.

The hinged grid may be in the form of a panel supporting the offset ribs in the operative position at a spaced axial distance from a downstream end of the barrel. The panel may include a cylinder defining a foam collecting chamber coaxial with the barrel in the operative position, the offset ribs being supported in the cylinder adjacent the downstream end thereof.

The cylinder may be sized relative to the barrel to therewith define an annular aspiration opening in communication with air inlet openings provided in an adapter which includes the supplemental foam generator. Otherwise, the cylinder may be provided with air aspiration openings for aspirating the collecting chamber independently of such air inlet openings.

Other objects, advantages and novel features of the invention will become more apparent from the following detailed description of the invention when taken in conjunction with the accompanying drawings.

DETAILED DESCRIPTION OF THE INVENTION

Figure 1:
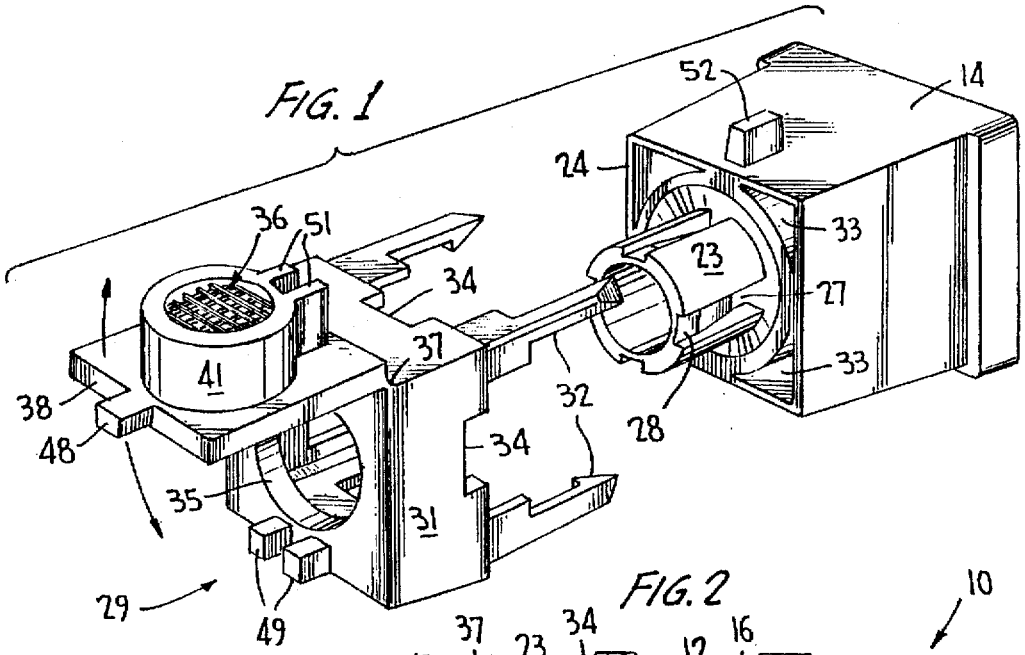
FIG. 1 is an expanded view, in perspective, of the foamer nozzle assembly according to one embodiment of the invention which includes a supplemental foam generator or adapter to be mounted on the foamer nozzle of a trigger sprayer.

Turning now to the drawings wherein like reference characters refer to like and corresponding parts throughout the several views, the trigger sprayer to which the foamer nozzle assembly according to the invention is mounted is best shown, in part, in FIGS. 2 to 5, generally designated 10 of known construction as having a trigger actuator 11 and a discharge end 12 into which liquid product flows through a discharge passage 13 upon pumping operation.

A nozzle cap 14 having a central discharge orifice 15 is snap-fitted or otherwise mounted about discharge end 12 as at 16. The cap has an internal sleeve 17 in engagement with a probe cap 18 carrying an annular discharge flap valve 19. The probe cap is fixed to the end of a probe 21, and has a swirl chamber formed at its outer end with longitudinal grooves on the probe cap and sleeve being aligned upon relative rotation of the nozzle cap for admitting liquid product via the discharge valve through tangential channels into the swirl chamber upon pumping operation for inducing a swirl to the product to issue through the discharge orifice as a conical spray, as described in more detail in the aforementioned related application.

According to the invention nozzle cap 14 has a fixed barrel 23 extending downstream from end wall 24 of the cap which contains the discharge orifice. The barrel may be integrally formed with the nozzle cap during a one-piece molding operation. The barrel is concentric with the orifice and has a smooth inner wall 25 defining a turbulence chamber 26 such that, during pumping, the conical spray impacts against smooth inner wall 25 thereby creating and concentrating a foam as the spray particles mix with air in the turbulence chamber as aspirated through openings 27 at the base of the barrel, as will be described in more detail hereinafter. These radial openings are located at the upstream ends of tapered grooves 28 formed during the molding process.

A supplemental foam generating assembly or adapter 29 according to the invention may be in the form of a four-sided cap 31 having snap legs 32 engaged in openings 33 formed at end wall 24 of the nozzle cap for mounting assembly 29 thereto. The cap side walls are flush with the four side walls of the nozzle cap in the assembled position of FIG. 2. Each of the cap 31 side walls has a notch 34 forming an air inlet opening communicating with aspiration openings 27 for aspirating turbulence chamber 26.

Figure 6:
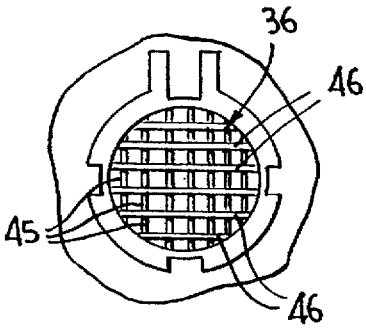
FIG. 6 is a plan view taken substantially along the line 6—6 of FIG. 2.

Cap 31 has a central opening 35 coaxial with the discharge orifice, the assembly including a hinged grid 36 (FIG. 6) pivotable about a hinge axis 37 formed as a live hinge interconnecting a transverse edge of cap 31 and an edge of a panel 38 supporting the grid. The panel is pivotable between its operative position of FIG. 2 in which the grid is coaxial with barrel 23, and its inoperative position of FIG. 3 in which the panel and its grid are hinged away from the barrel.

Figure 2:
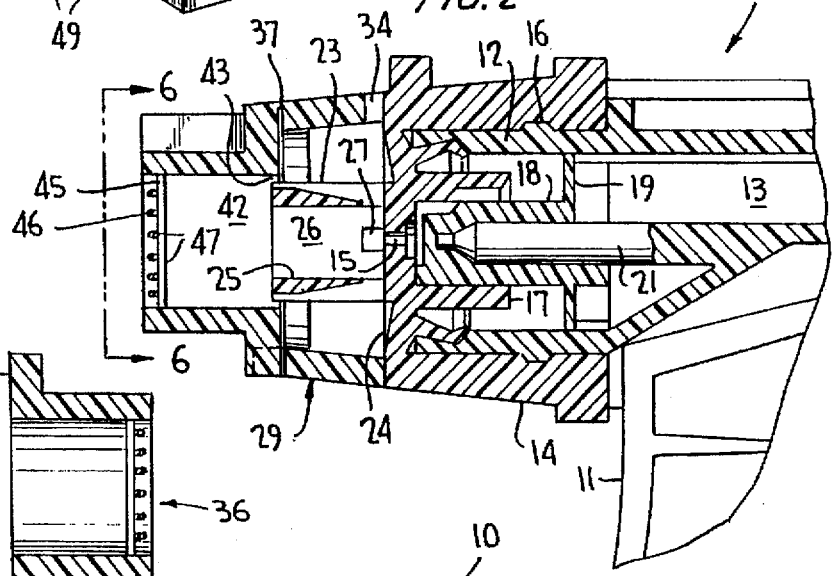
FIG. 2 is a vertical sectional view of the FIG. 1 embodiment as assembled and mounted to the discharge end of a trigger sprayer, with the supplemental foam generator shown in its operative position.

The foaming grid is supported at a spaced axial distance from downstream end 39 of foaming barrel 23 in the FIG. 2 operative position.

A cylinder 41, which may be integrally formed with panel 38, extends in a downstream direction and supports foaming grid 36 adjacent its downstream end.

Cylinder 41 defines a foam collecting chamber 42, the cylinder in the FIG. 2 embodiment having an inner diameter slightly greater than the outer diameter of barrel 23 to thereby define an annular gap 43 which communicates with air inlet openings 34 for aspirating chamber 42. Otherwise, the inner diameter of cylinder 41 could be substantially equal to the outer diameter of the barrel such that, in the operative position of FIG. 2, the cylinder simply telescopes over the barrel without presenting any annular gap. Grooves 28 thus establish aspiration passages in communication with air inlet openings 34 for aspirating chamber 42.

Figure 4:
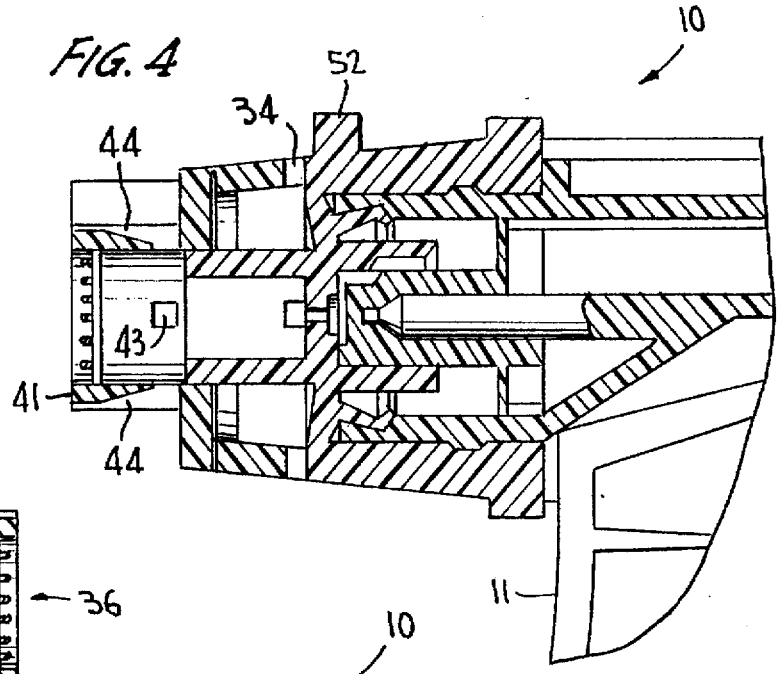
FIG. 4 is a view similar to FIG. 2 of another embodiment of the invention, with the supplemental foam generator shown in its operative position.
Figure 5:
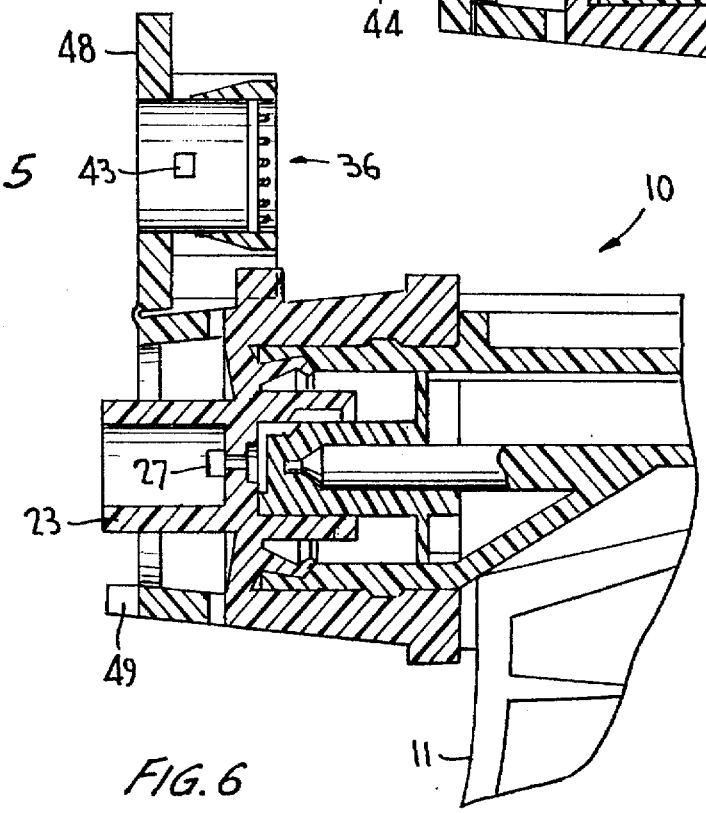
FIG. 5 is a view similar to FIG. 4 with the supplemental foam generator shown in its inoperative position.

Still further, as shown in the FIGS. 4, 5 embodiment, cylinder 41 may be provided with a plurality of radial openings 43, formed at the inner end of grooves 44 during the molding process, for aspirating air into chamber 42 independently of air inlet openings 34.

Grid 36 is the same offset rectangular molded mesh foaming screen as described in greater detail in FIGS. 7 and 8 of the aforementioned '539 patent.

Thus, the grid comprises a first set of mutually spaced apart ribs 45, shown in the drawings as vertically extending, and a second set of ribs 46 mutually spaced apart and shown in the drawings as horizontally extending. As shown, the ribs of the first set are contiguous to (i.e., in contact with) the ribs of the second set. The grid thus comprises an offset rectangular mesh screen of molded plastic wherein ribs 45, 46 are integrally formed.

The spaced apart ribs of both sets of ribs define uniformly sized opening therebetween such as rectangular openings of equal size except for those openings lying adjacent cylinder 41. Of course, the uniformly sized openings may be other than rectangular, as shown in the aforementioned '539, without departing from the invention.

The ribs of both sets have flat surfaces 47 facing upstream so as to confront the spray/foam flow moving downstream in chamber 42. The flat surfaces of the ribs confronting chamber 42 provide impact surfaces for the foam bubbles formed in turbulence chamber 26, enhance the foaming formation, and facilitate virtually unimpeded discharge of foam through the grid outwardly of the discharge end of cylinder 41.

Figure 3:
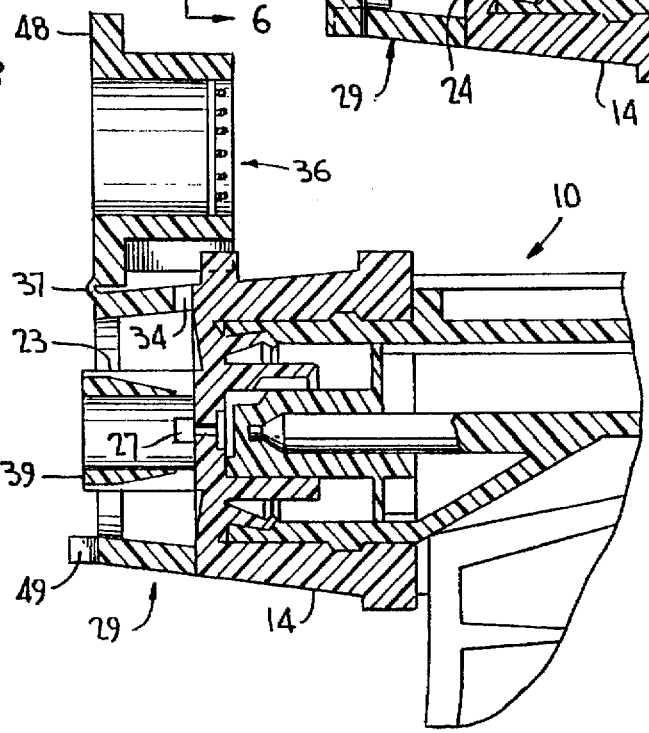
FIG. 3 is a view similar to FIG. 2 with the supplemental foam generator shown in its inoperative position.

In operation, with panel 28 hinged upwardly into its inoperative position of FIGS. 1, 3 and 5, each squeeze of the trigger, after the pump is primed, discharges foamable liquid through discharge orifice 15 as a conical spray into chamber 26 which is so designed as to have the spray particles of the plume impact against smooth inner wall 25 of barrel 23 thereby creating and concentrating a foam as the spray particles mix with air in turbulence chamber 26 as aspirated through openings 34 and 27. The foam created exits the downstream end of the barrel as a relatively large foam spread of relatively large foam bubbles loosely compacted.

Flat surfaces 47 lie in axially spaced parallel planes perpendicular to the central axis of cylinder 41. Ribs 45 and 46 of each of the sets of ribs are rectangular in cross-section with the longer sides thereof extending along the downstream direction of product flow from the discharge orifice, as described in detail for FIGS. 7 and 8 in the aforementioned '539 patent.

As therein described, the disposition of the longer sides of the ribs along the flow path enhances the foaming formation as the foam bubbles concentrated in the turbulence chamber first impact against the flat surfaces of ribs 45, glide along the long sides of ribs 45 which accelerate the turbulent flow as the foam bubbles then impact against the flat surfaces of ribs 46 and glide along the long sides thereof which further accelerate the turbulent flow. The foam mixes with air in chamber 42.

Panel 38 may be provided with a transversely extending tab 48 to assist in manual movement of the grid between its operative and inoperative positions. In the FIG. 2 inoperative position, tab 48 frictionally engages a pair of spaced projections 49 for locking the panel in place.

The panel and its grid may be positively retained in the FIG. 3 inoperative position by the provision of a pair of spaced projections 51 transversely extending from cylinder 41 for frictional engagement with a peg 52 extending from nozzle cap 14 in alignment with projections 51 so as to interengage, as shown in FIG. 3.

In operation, upon actuation of the trigger sprayer in the inoperative position of the foaming grid shown in FIGS. 3 and 5, the conical spray issuing from discharge orifice 15 impacts against smooth inner wall 25 of barrel 23 such that foam is created and concentrated in turbulence chamber 26. The foam issues from downstream end 39 of barrel 23 in the form of relatively large and loosely compacted air bubbles yielding a relatively large foam spread.

Upon operation of the trigger with panel 38 in its closed and operative position of FIGS. 2 and 4, the relatively large foam bubbles issuing from the downstream end 39 of the barrel are pushed through the offset rectangular mesh which subjects the foam bubbles to additional turbulence while mixing with air in chamber 42 as inletted through openings/notches 34 and grooves 28 and or annular gap between 43.

The foam bubbles in chamber 42 impact against flat surfaces 47 of ribs 45, travel along the longer sides thereof which enhances the foaming formation, then impact against the flat surfaces 47 of the further set of ribs 46, and travel along the long sides of these ribs which still further enhances the foaming formation. The foam emerges from the foaming grid in a more concentrated form with smaller bubbles in a relatively smaller foam spread.

Obviously, many other modifications and variations of the present invention are made possible in the light of the above teachings. For example, other air aspiration openings or passages into chamber 42 from that disclosed can be developed without departing from the scope of the invention. Also, panel 38 could be retained in its operative position by some type of snap-fit engagement with cap 31, and could be maintained in its hinged away position likewise by some type of snap fit engagement with nozzle cap 14. It is therefore to be understood that within the scope of the appended claims the invention may be practiced otherwise than as specifically described.

What is claimed is:

1. A foamer nozzle assembly mounted at a discharge end of a trigger sprayer, comprising, a nozzle cap having a foaming barrel with a smooth inner wall of a given diameter defining a turbulence chamber coaxial with a discharge orifice located in an end wall of the cap at said discharge end through which a conical spray is discharged in a downstream direction into said chamber for generating foam as spray particles impact against said smooth inner wall to mix with air in said chamber to form foam bubbles of a given size and density, supplemental foam generating means of molded plastic construction mounted to said nozzle cap and having air inlet openings in communication with air aspiration openings in said barrel, said means including a hinged grid pivotable about a hinge axis between an operative position coaxial with said barrel and an inoperative position hinged away from said barrel, said grid comprising first and second sets of ribs respectively lying in first and second parallel planes, said ribs of said first set being contiguous to said ribs of said second set, said ribs being mutually spaced apart in each said set to define uniformly sized openings therebetween, said ribs of both said sets having flat surfaces facing upstream and lying perpendicular to a central axis of said barrel in said operative position for generating a finer and more dense foam as the foam bubbles impact against said flat surfaces to further mix with air in said supplemental foam generating means, said hinged grid including a cylinder supporting said ribs in said operative position at a spaced axial distance from a downstream end of said barrel, said cylinder being sized relative to said barrel to define an annular gap therewith in communication with said air inlet openings for aspirating said foam collecting chamber in said operative position.

2. A foamer nozzle assembly mounted at a discharge end of a trigger sprayer, comprising, a nozzle cap having a foaming barrel with a smooth inner wall of a given diameter defining a turbulence chamber coaxial with a discharge orifice located in an end wall of the cap at said discharge end through which a conical spray is discharged in a downstream direction into said chamber for generating foam as spray particles impact against said smooth inner wall to mix with air in said chamber to form foam bubbles of a given size and density, supplemental foam generating means of molded plastic construction mounted to said nozzle cap and having air inlet openings in communication with air aspiration openings in said barrel, said means including a hinged grid pivotable about a hinge axis between an operative position coaxial with said barrel and an inoperative position hinged away from said barrel, said grid comprising first and second sets of ribs respectively lying in first and second parallel planes, said ribs of said first set being contiguous to said ribs of said second set, said ribs being mutually spaced apart in each said set to define uniformly sized openings therebetween, said ribs of both said sets having flat surfaces facing upstream and lying perpendicular to a central axis of said barrel in said operative position for generating a finer and more dense foam as the foam bubbles impact against said flat surfaces to further mix with air in said supplemental foam generating means, said hinged grid including a cylinder supporting said ribs in said operative position at a spaced axial distance from a downstream end of said barrel, said cylinder being sized relative to said barrel so as to telescopically engage said barrel in said operative position, said cylinder having air aspiration openings for aspirating said foam collecting chamber independently of said air inlet openings.

* * * * *